US008315856B2

(12) United States Patent
Nyquist et al.

(10) Patent No.: US 8,315,856 B2
(45) Date of Patent: Nov. 20, 2012

(54) IDENTIFY FEATURES OF SPEECH BASED ON EVENTS IN A SIGNAL REPRESENTING SPOKEN SOUNDS

(75) Inventors: Joel K. Nyquist, Louisville, CO (US); Erik N. Reckase, Berthoud, CO (US); Matthew D. Robinson, Denver, CO (US); John F. Remillard, Fort Collins, CO (US)

(73) Assignee: Red Shift Company, LLC, Ridgewood, NJ (US)

( * ) Notice: Subject to any disclaimer, the term of this patent is extended or adjusted under 35 U.S.C. 154(b) by 1063 days.

(21) Appl. No.: 12/256,706

(22) Filed: Oct. 23, 2008

(65) Prior Publication Data

US 2009/0271197 A1 Oct. 29, 2009

Related U.S. Application Data

(60) Provisional application No. 60/982,257, filed on Oct. 24, 2007.

(51) Int. Cl.
*G10L 19/06* (2006.01)

(52) U.S. Cl. ..... 704/209

(58) Field of Classification Search ..... 704/208
See application file for complete search history.

(56) References Cited

U.S. PATENT DOCUMENTS

| | | | | |
|---|---|---|---|---|
| 5,400,434 | A | 3/1995 | Pearson | |
| 5,495,555 | A * | 2/1996 | Swaminathan | 704/207 |
| 5,699,477 | A * | 12/1997 | McCree | 704/216 |
| 5,799,276 | A | 8/1998 | Komissarchik et al. | |
| 5,799,279 | A | 8/1998 | Gould et al. | |
| 6,006,175 | A | 12/1999 | Holzrichter | |
| 6,463,406 | B1 * | 10/2002 | McCree | 704/207 |
| 6,475,245 | B2 | 11/2002 | Gersho et al. | |
| 6,879,955 | B2 * | 4/2005 | Rao | 704/241 |
| 6,931,373 | B1 * | 8/2005 | Bhaskar et al. | 704/230 |
| 7,228,272 | B2 * | 6/2007 | Rao | 704/219 |
| 7,272,556 | B1 * | 9/2007 | Aguilar et al. | 704/230 |
| 7,693,710 | B2 * | 4/2010 | Jelinek et al. | 704/207 |
| 2004/0125878 | A1 | 7/2004 | Liljeryd et al. | |

(Continued)

OTHER PUBLICATIONS

Albrecht-Buehler, Guenter et al., "Cell intelligence," http://www.basic.northwestern.edu/g-buehler/cellint0.htm, Jul. 2006, 21 pgs.

(Continued)

*Primary Examiner* — Michael N Opsasnick

(74) *Attorney, Agent, or Firm* — Kilpatrick Townsend & Stockton LLP

(57) ABSTRACT

Methods, systems, and machine-readable media are disclosed for processing a signal representing speech. According to one embodiment, processing a signal representing speech can comprise receiving a region of the signal representing speech. The region can comprise a portion of a frame of the signal representing speech classified as a voiced frame. The region can be marked based on one or more pitch estimates for the region. A cord can be identified within the region based on occurrence of one or more events within the region of the signal. For example, the one or more events can comprise one or more glottal pulses. In such cases, cord can begin with onset of a first glottal pulse and extend to a point prior to an onset of a second glottal pulse. The cord may exclude a portion of the region of the signal prior to the onset of the second glottal pulse.

20 Claims, 10 Drawing Sheets

U.S. PATENT DOCUMENTS

| | | | | |
|---|---|---|---|---|
| 2005/0154584 | A1 * | 7/2005 | Jelinek et al. | 704/219 |
| 2006/0136206 | A1 | 6/2006 | Ariu et al. | |
| 2007/0150277 | A1 | 6/2007 | Kim | |

OTHER PUBLICATIONS

Gudrais, Elizabeth, "Neurons Sort Nouns," Harvard Magazine, Jul.-Aug. 2006, 2pgs.
Kurt, Simon et al., "Auditory Cortical Contrast Enhancing by Global Winner-Take-All Inhibitory Interactions," PLoS One, Mar. 2008, vol. 3, Issue 3, www.plosone.org, pp. 1-12.
Horgan, John, "We're Cracking the Neural Code, the Brain's Secret Language," from Adbusters #63, Jan.-Feb. 2006, 2pgs.
Scientists Find Clues to Crack "Neural Code" of the Brain, Sep. 13, 2007, http://www.medicalnewstoday.com/articles/82325.php, 4 pgs.
"The Rods and Cones of the Human Eye," Sep. 20, 2007, http://hyperphysics.phy-astr.gsu.edu/hbase/vision/rodcone.html, 5 pgs.
"Color Perception," Sep. 20, 2007, http://hyperphysics.phy-astr.gsu.edu/hbase/vision/colper.html, 4 pgs.
Mill, Robert et al., "Auditory-Based Time-Frequence Representations and Feature Extraction Techniques for Sonar Processing," Speech and Hearing Research Group, Dept. of Computer Science, Univ. of Sheffield, Oct. 2005, CS-05-12, pp. 1-71.
White Paper, "The Next Generation of Voice Quality: The Audience Voice Processor with Instantaneous Noise Suppression," Audience, Inc., www.audience.com, 2008, 8 pgs.
Patent Cooperation Treaty (RO/US), International Search Report and Written Opinion of the International Search Authority, Dec. 23, 2008, pp. 1-16, Int'l Patent Appl. No. PCT/US2008/081160 filed Oct. 24, 2008.
Patent Cooperation Treaty (RO/US), International Search Report and Written Opinion of the International Search Authority, Dec. 19, 2008, pp. 1-7, Int'l Patent Appl. No. PCT/US2008/081180 filed Oct. 24, 2008.
Patent Cooperation Treaty (RO/US), International Search Report and Written Opinion of the International Search Authority, Dec. 19, 2008, pp. 1-8, Int'l Patent Appl. No. PCT/US2008/081187 filed Oct. 24, 2008.
M. Kahn, "Pitch Is Key to Cocktail Party Conversation: Study", Mar. 5, 2008, 1 page, http://www.reuters.com/article/idUSL0492989320080305?feedType=RSS&feedName=scienceNews.
K. Simone et al., "Auditory Cortical Contrast Enhancing by Global Winner-Take-All Inhibitory Interactions", Mar. 5, 2008, 12 pages, PLoS One, vol. 3, Issue 3, e1735, http://www.plosone.org/article/info:doi/10.1371/journal.pone.0001735.
Audience, "White Paper: The Next Generation of Voice Quality: The Audience Voice Processor With Instantaneous Noise Suppression", 2008, 8 pages, AUD-WP-MC1-VO1, Audience, Inc., www.audience.com.

* cited by examiner

IDENTIFY FEATURES OF SPEECH BASED ON EVENTS IN A SIGNAL REPRESENTING SPOKEN SOUNDS

CROSS-REFERENCE TO RELATED APPLICATIONS

This application claims the benefit of U.S. Provisional Application No. 60/982,257, filed Oct. 24, 2007 by Nyquist et al., and entitled SPEECH RECOGNITION SYSTEMS AND METHODS the entire disclosure of which is incorporated herein by reference for all purposes.

This application is also related to the following applications, of which the entire disclosure of each is incorporated herein by reference for all purposes:

U.S. patent application Ser. No. 12/256,693 filed Oct. 23, 2008 by Reckase et al and entitled PITCH ESTIMATION AND MARKING OF A SIGNAL REPRESENTING SPEECH;

U.S. patent application Ser. No. 12/256,710 filed Oct. 23, 2008 by Nyquist et al and entitled PRODUCING TIME UNIFORM FEATURE VECTORS;

U.S. patent application Ser. No. 12/256,716 filed Oct. 23, 2008 by Nyquist et al and entitled PRODUCING PHONITOS BASED ON FEATURE VECTORS; and U.S. patent application Ser. No. 12/256,729 filed Oct. 23, 2008 by Nyquist et al and entitled CLASSIFYING PORTIONS OF A SIGNAL REPRESENTING SPEECH.

BACKGROUND OF THE INVENTION

Embodiments of the present invention generally relate to speech processing. More specifically, embodiments of the present invention relate to processing a signal representing speech based on occurrence of events within the signal.

Various techniques for electronically processing human speech have been and continue to be developed. Generally speaking, these techniques involve reading and analyzing an electrical signal representing the speech, for example as generated by a microphone, and performing processing thereon such as trying to determine the spoken sounds represented by the signal. The spoken sounds are then assembled to replicate the words, sentences, etc. that are being spoken. However, such electrical signals created by human speech are considered to be extremely complex. Furthermore, determining exactly how such signals are interpreted by the human ear and brain to represent intelligible words, ideas, etc. has proven to be rather challenging.

Previous techniques of speech processing have sought to model the process performed by the human ear and brain by analyzing the entirety of the electrical signal representing the speech. However, the previous approaches have had somewhat limited success in accurately recognizing or replicating the spoken words or otherwise processing the signal representing speech. The previous techniques of speech processing have sought to improve accuracy by increasingly adding complexity to the algorithms used to process the spoken sounds, words, etc. However, as the resource overhead of these systems continues to grow, the improvements in accuracy and/or fidelity of speech processing systems seems to not improve to a corresponding level. Rather, various speech processing systems continue to evolve that require more and more resource overhead while providing only marginal improvements in accuracy, fidelity, etc. Hence, there is a need in the art for improved methods and systems for speech processing.

BRIEF SUMMARY OF THE INVENTION

Methods, systems, and machine-readable media are disclosed for processing a signal representing speech. According to one embodiment, a method of processing a signal representing speech can comprise receiving a region of the signal representing speech. The region can comprise a portion of a frame of the signal representing speech classified as a voiced frame. The region can be marked based on one or more pitch estimates for the region. A cord can be identified within the region of the signal based on occurrence of one or more events within the region of the signal. For example, the one or more events can comprise one or more glottal pulses. In such cases, cord can begin with onset of a first glottal pulse and extend to a point prior to an onset of a second glottal pulse. The cord may exclude a portion of the region of the signal prior to the onset of the second glottal pulse.

Identifying the cord within the region of the signal can comprise locating the first glottal pulse within the region of the signal. Locating the first glottal pulse can comprise locating a point of highest amplitude within the region of the signal. The second glottal pulse within the region of the signal can also be located. Locating the second glottal pulse can comprise checking for presence of a high-amplitude spike in the region of the signal a predetermined distance from the first glottal pulse. In response to determining that no glottal pulse is located within the predetermined distance from the first glottal pulse, a check can be made for presence of a high-amplitude spike in the region of the signal at twice the predetermined distance from the first glottal pulse. In response to locating the second glottal pulse, a determination can be made as to whether the second glottal pulse is located within a predetermined maximum distance of the first glottal pulse. In response to determining the second glottal pulse is not located within the predetermined maximum distance of the first glottal pulse, the second glottal pulse may be disregarded.

A termination of the cord can be identified based on the first glottal pulse and the second glottal pulse. Identifying the termination of the cord based on the first glottal pulse and the second glottal pulse can comprise identifying a beginning of the first glottal pulse based on a first negative-to-positive zero crossing in the voiced frame and prior to the first glottal pulse. A beginning of the second glottal pulse can be identified based on a second negative-to-positive zero crossing in the voiced frame and prior to the second glottal pulse. A third negative-to-positive zero crossing can be identified prior to the second negative-to-positive zero crossing. The termination of the cord can be set to the third negative-to-positive zero crossing.

According to another embodiment, a system can comprise an input device adapted to detect sound representing speech and convert the sound to an electrical signal representing the speech. A classification module can be communicatively coupled with the input device. The classification module can be adapted to receive a frame of the signal representing speech and classify the frame as a voiced frame. A pitch estimation and marking module can be communicatively coupled with the classification module. The pitch estimation and marking module can be adapted to mark a region of the voiced frame based on one or more pitch estimates for the region. A cord finder module can be communicatively coupled with the pitch estimation and marking module. The cord finder module can be adapted to identify a cord within the region of the signal based on occurrence of one or more events within the region of the signal. The one or more events can comprise one or more glottal pulses. The cord can begin with onset of a first glottal pulse and extend to a point prior to an onset of a second glottal pulse but may exclude a portion of the region of the signal prior to the onset of the second glottal pulse.

Identifying the cord within the region of the signal can comprise locating the first glottal pulse within the region of the signal. Locating the first glottal pulse can comprise locating a point of highest amplitude within the region of the signal. The cord finder module can be further adapted to locate the second glottal pulse within the region of the signal. Locating the second glottal pulse can comprise checking for presence of a high-amplitude spike in the region of the signal a predetermined distance from the first glottal pulse. In some cases, the cord finder module can be further adapted to check for presence of a high-amplitude spike in the region of the signal at twice the predetermined distance from the first glottal pulse in response to determining that no glottal pulse is located within the predetermined distance from the first glottal pulse. The cord finder module can be further adapted to determine whether the second glottal pulse is located within a predetermined maximum distance of the first glottal pulse in response to locating the second glottal pulse. The second glottal pulse may be discarded by the cord finer module in response to determining the second glottal pulse is not located within the predetermined maximum distance of the first glottal pulse.

The cord finder module can be further adapted to identify a termination of the cord based on the first glottal pulse and the second glottal pulse. Identifying the termination of the cord based on the first glottal pulse and the second glottal pulse can comprise identifying a beginning of the first glottal pulse based on a first negative-to-positive zero crossing in the voiced frame and prior to the first glottal pulse. A beginning of the second glottal pulse can be identified based on a second negative-to-positive zero crossing in the voiced frame and prior to the second glottal pulse. A third negative-to-positive zero crossing can be identified prior to the second negative-to-positive zero crossing. The termination of the cord can be set to the third negative-to-positive zero crossing.

According to yet another embodiment, a machine-readable medium can have stored therein a series of instruction which, when executed by a processor, cause the processor to process a signal representing speech by receiving a region of the signal representing speech. The region can comprise a portion of a frame of the signal representing speech classified as a voiced frame and the region can be marked based on one or more pitch estimates for the region. A cord can be identified within the region of the signal based on occurrence of one or more events within the region of the signal. The one or more events can comprise one or more glottal pulses and the cord can begin with onset of a first glottal pulse and extend to a point prior to an onset of a second glottal pulse but may exclude a portion of the region of the signal prior to the onset of the second glottal pulse.

DETAILED DESCRIPTION OF THE INVENTION

Figure 1:
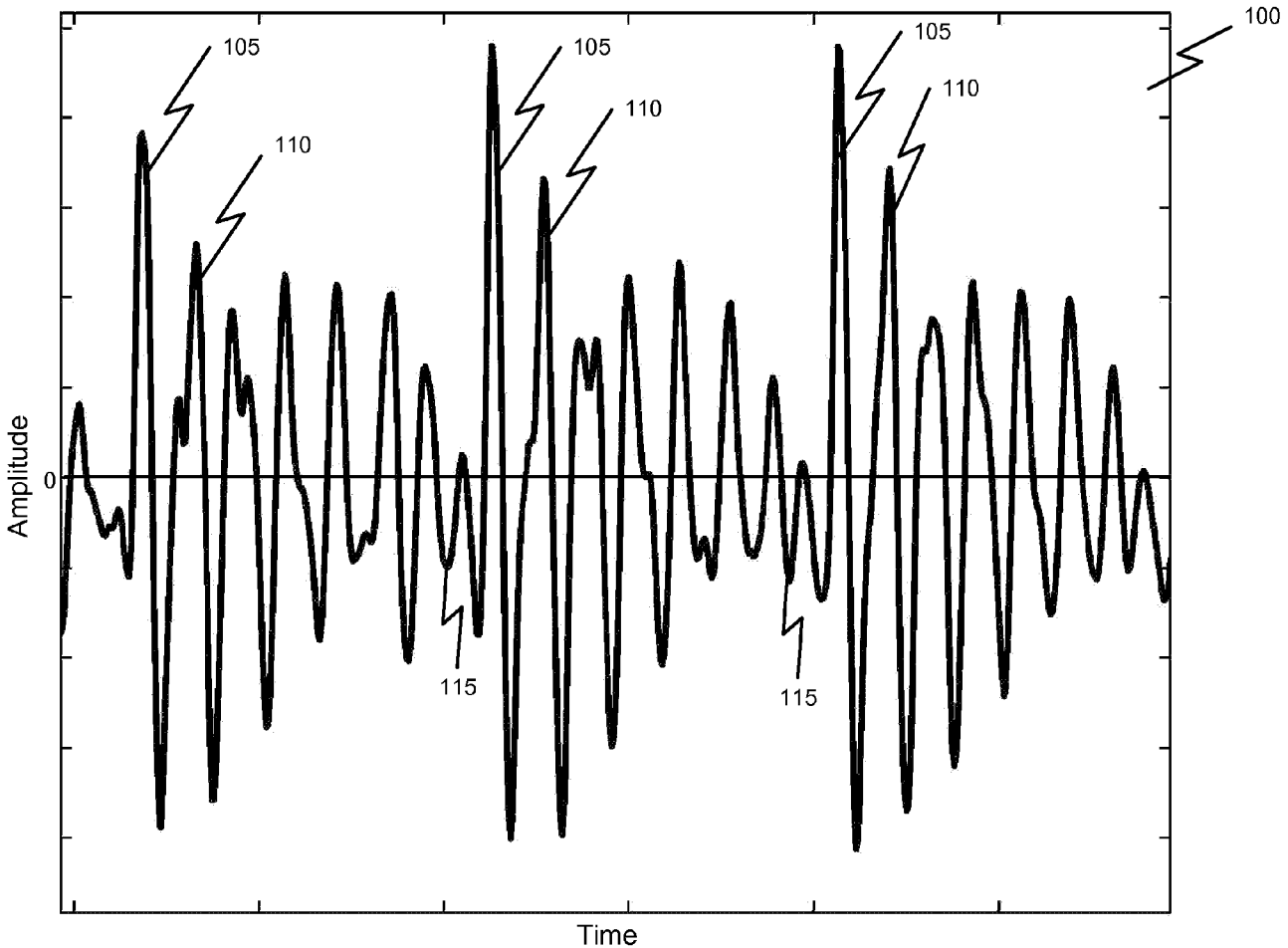
FIG. 1 is a graph illustrating an exemplary electrical signal representing speech.

In the following description, for the purposes of explanation, numerous specific details are set forth in order to provide a thorough understanding of the present invention. It will be apparent, however, to one skilled in the art that the present invention may be practiced without some of these specific details. In other instances, well-known structures and devices are shown in block diagram form.

The ensuing description provides exemplary embodiments only, and is not intended to limit the scope, applicability, or configuration of the disclosure. Rather, the ensuing description of the exemplary embodiments will provide those skilled in the art with an enabling description for implementing an exemplary embodiment. It should be understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments may be practiced without these specific details. For example, circuits, systems, networks, processes, and other components may be shown as components in block diagram form in order not to obscure the embodiments in unnecessary detail. In other instances, well-known circuits, processes, algorithms, structures, and techniques may be shown without unnecessary detail in order to avoid obscuring the embodiments.

Also, it is noted that individual embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in a figure. A process may correspond to a method, a function, a procedure, a subroutine, a subprogram, etc. When a process corresponds to a function, its termination can correspond to a return of the function to the calling function or the main function.

The term "machine-readable medium" includes, but is not limited to portable or fixed storage devices, optical storage devices, wireless channels and various other mediums capable of storing, containing or carrying instruction(s) and/or data. A code segment or machine-executable instructions may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

Furthermore, embodiments may be implemented by hardware, software, firmware, middleware, microcode, hardware description languages, or any combination thereof. When implemented in software, firmware, middleware or microcode, the program code or code segments to perform the necessary tasks may be stored in a machine readable medium. A processor(s) may perform the necessary tasks.

Generally speaking, embodiments of the present invention relate to speech processing such as, for example, speech recognition. As will be described in detail below, speech processing according to one embodiment of the present invention can be performed based on the occurrence of events within the electrical signals representing speech. As will be seen, such events need not comprise instantaneous occurrences but rather, an occurrence within the electrical signal spanning some period of time. Furthermore, the electrical signal can be analyzed based on the occurrence and location of these events so that less than all of the signal is analyzed. That is, the spoken sounds can be processed based on regions of the signal around and including the events but excluding other portions of the signal. For example, transition periods before the occurrence of the events may be excluded to eliminate noise or transients introduced at that part of the signal.

Stated another way and according to one embodiment, processing speech can comprise receiving a signal representing speech. At least a portion of the signal can be classified as a voiced frame. The voiced frame can be parsed into one or more regions based on occurrence of one or more events within the voiced frame. For example, the one or more events can comprise one or more glottal pulses, i.e., a pulse in the electrical signal representing the spoken sounds created by movement of the glottis in the throat of the speaker. According to one embodiment, the one or more regions can collectively represent less than all of the signal. For example, each of the one or more regions can include one or more cords comprising a part of the signal beginning with the glottal pulse but exclude a part of the signal prior to a start of a subsequent glottal pulse. As used herein, the term cord refers to a part of a voiced frame of the electrical signal representing speech beginning with one set of a glottal pulse and extending to a point prior to the beginning of a neighboring glottal pulse but excluding a portion of the signal prior to the onset of the neighboring glottal pulse, e.g., transients. In another example, rather than excluding the part of the signal prior to the start of a subsequent or neighboring glottal pulse, that portion of the signal can be filtered or otherwise attenuated such that the transients or other contents of that portion of the signal do not significantly influence further processing of the signal.

The one or more cords can be analyzed, for example to recognize the speech. In such an implementation, analyzing the one or more cords can comprise performing a spectral analysis on each of the one or more cords and determining a phoneme represented by each of the one or more cords based on the spectral analysis. In some cases, the phoneme represented by each of the one or more cords can be passed to a word or phrase classifier for further processing. In other implementations, various other processing can be performed on the one or more cords including but not limited performing or enhancing noise reductions and/or filtering. In such an implementation, the cords can be used by a filter and/or amplifier to identify or match those frames to be amplified or filtered. These and other implementations are described, for example, in the Related Applications entitled PRODUCING TIME UNIFORM FEATURE VECTORS and PRODUCING PHONITOS BASED ON FEATURE VECTORS referenced above. Other variations and implementations are contemplated and considered to be within the scope of the present invention.

It should be understood that various embodiments of the methods and system described herein can be implemented in various environments and/or devices and used for any of a variety of different purposes. For example, in one embodiment, the methods and systems described here may be used in conjunction with software such as a natural language processor or other speech recognition software to perform speech recognition or to enhance the speech recognition abilities of another software package. Either alone or in combination with such other software, embodiments of the present invention may be used to implement a speech-to-text application or a speech-to-speech application. For example, embodiments of the present invention may be implemented in software executing on a computer for receiving and processing spoken words to perform speech-to-text functions, provide a voice command interface, perform Interactive Voice Response (IVR) functions and/or other automated call center functions, to provide speech-to-speech processing such as amplifying, clarifying, and/or translating spoken language, or to perform other functions such as noise reduction, filtering, etc. Various devices or environments in which various embodiments of the present invention may be implemented include but are not limited to telephones, portable electronic devices, media players, household appliances, automobiles, control systems, biometric access or control systems hearing aids, cochlear implants, etc. Other devices or environments in which various embodiments of the present invention may be implemented are contemplated and considered to be within the scope of the present invention.

FIG. 1 is a graph illustrating an exemplary electrical signal representing speech. This example illustrates an electrical signal 100 as may be received from a transducer such as a microphone or other device when detecting speech. The signal 100 includes a series of high-amplitude spikes referred to herein as glottal pulses 105. The term glottal pulse is used to described these spikes because they occur in the electrical signal 100 at a point when the glottis in the throat of the speaker causes a sound generating event. As will be seen, the glottal pulse 105 can be used to identify frames of the signal to be sampled and/or analyzed to determine a spoken sound represented by the signal.

Each glottal pulse 105 is followed by a series of peaks 110 and a period of transients 115 just prior to the start of a subsequent glottal pulse 105. According to one embodiment and as will be discussed further below, the glottal pulses 105 and the peaks 110 following the glottal pulses 105 can be used to provide a cord of the signal to be analyzed and processed, for example to recognize the spoken sound they represent. According to one embodiment, the period of transients 115 prior to a glottal pulse 105 may be excluded from the cord. That is, the transients 115, created as the speakers throat is changing in preparation for the next glottal pulse, do not add to the ability to accurately analyze the signal. Rather, analyzing the transients 115 may introduce inaccuracies and unnecessarily consume processing resources.

In other words, the signal 100 can be parsed into one or more cords based on occurrence of one or more glottal pulses 105. The one or more cords can collectively represent less than all of the signal 100 since each of the one or more cords can include a part of the signal beginning with the glottal pulse but exclude a part of the signal prior to a start of a subsequent glottal pulse, i.e., the transients 115. The one or more cords can be analyzed to recognize the speech.

Figure 2:
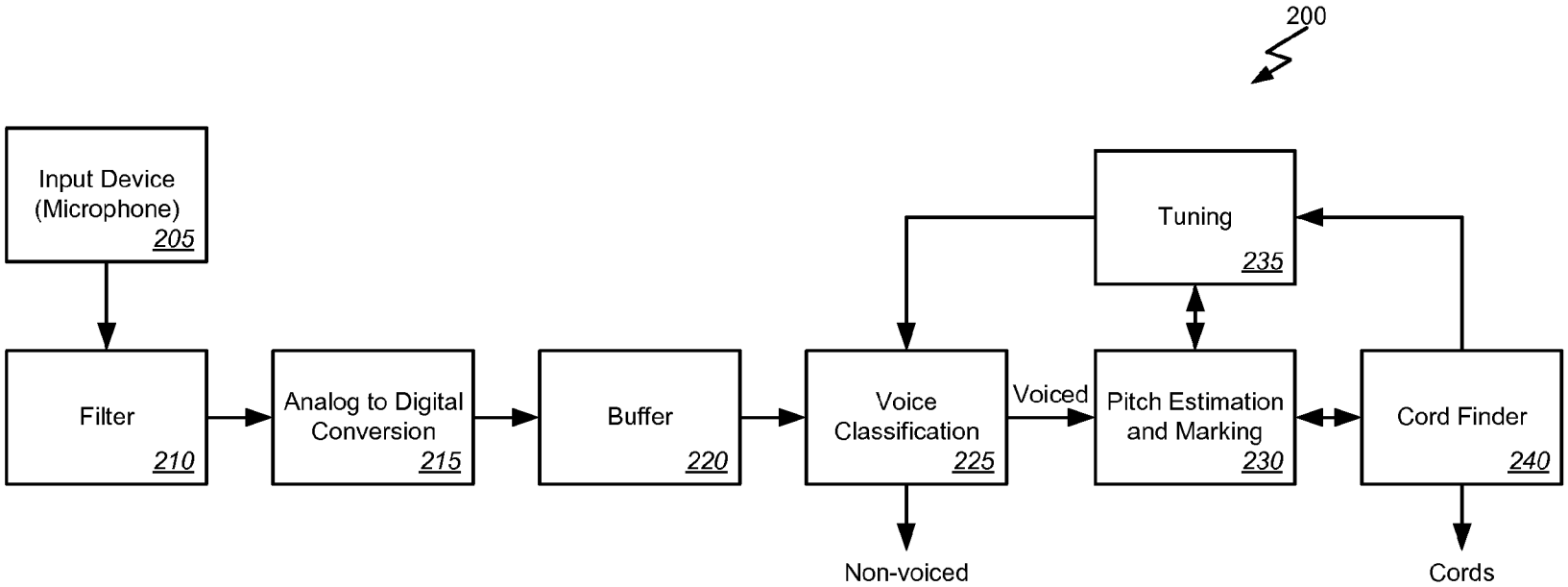
FIG. 2 is a block diagram illustrating components of a system for performing speech processing according to one embodiment of the present invention.

FIG. 2 is a block diagram illustrating components of a system for performing speech processing according to one embodiment of the present invention. In this example, the system 200 includes an input device 205 such as a microphone or other transducer for detecting and converting sound waves from the speaker to electrical signals. The system can also include a filter 210 coupled with the input device and adapted to filter or attenuate noise and other non-speech sound detected by the input device. The filter 210 output can be applied to an analog-to-digital converter 215 for conversion of the analog signal from the input device to a digital form in a manner understood by those skilled in the art. A buffer 220 may be included and coupled with the analog-to-digital converter 215 to temporarily store the converted signal prior to its use by the remainder of the system 200. The size of the buffer can vary depending upon the signals being processed, the throughput of the components of the system 200, etc. It should be noted that, in other cases, rather than receiving live sound from a microphone or other input device 205, sound may be obtained from an analog or digital recording and input into the system 200 in a manner that, while not illustrated here, can be understood by those skilled in the art.

The system 200 can also include a voice classification module 225 coupled with the filter 210 and/or input device 205. The voice classification module 225 can receive the digital signal representing speech, select a frame of the sample, e.g., based on a uniform framing process as known in the art, and classify the frame into, for example, "voiced," "unvoiced," or "silent." As used herein "voiced" refers to speech in which the glottis of the speaker generates a pulse. So, for example, a voiced sound would include vowels. "Unvoiced" refers to speech in which the glottis of the speaker does not move. So, for example, an unvoiced sound can include consonant sounds. A "silent" or quiet frame of the signal refers to a frame that does not include detectable speech.

As will be discussed below with reference to FIG. 6, classifying the frame of the signal can comprise determining a class based on the distance between consecutive zero crossings within a frame of the signal. So, for example, in response to this zero crossing distance in a frame of the signal exceeding a threshold amount, the frame can be classified as voiced. In another example, in response to the zero crossing distance within the frame of the signal not exceeding the threshold amount, the frame can be classified as unvoiced.

A pitch estimation and marking module 230 can be communicatively coupled with the classification module 225. Generally speaking, the pitch estimation and marking module 230 can parse or mark the voiced frame into one or more regions based on an estimated pitch for that region and the occurrence of events, i.e., glottal pulses within the signal. As used herein, the term "region" is used to refer to a portion of a frame of the electrical signal representing speech where the portion has been marked by the pitch marking process. Details of exemplary processes for pitch estimation and marking as may be performed by the pitch estimation and marking module 225 are described below with reference to FIGS. 7 and 8.

According to one embodiment, the system 200 can also include a tuning module 235 communicatively coupled with the pitch estimation and marking module 230. The tuning module 235 can be adapted to tune or adjust the pitch marking process. More specifically, the tuning module 235 can check the gaps between the marked events within the region. If a gap between any two events exceeds an expected gap, a check can be made for an event occurring between the marked events. For example, the expected gap can be based on the expected distance between events for a given pitch estimate. If the gap equals a multiple of that expected gap, the gap can be considered to be excessive and a check can be made for an event falling within the gap. It should be understood that wile illustrated here as separate from the pitch estimation and marking module 230, the functions of the tuning module 235 can be alternatively performed by the pitch estimation and marking module 230. Furthermore, it should be understood that the functions of the tuning module 235, regardless of how or where performed are considered to be optional and may be excluded from some implementations.

Once a frame of the signal has been classified by the voice classification module 225, a pitch marking has been performed by the pitch estimation and marking module 230, and any tuning has been performed by the tuning module 235, that region of the signal can be passed to a cord finder 240 coupled with the pitch estimation and marking module 230. Generally speaking, the cord finder 240 can further parse the region of the signal into one or more cords based on occurrence of one or more events, e.g., the glottal pulses. As will be discussed below with reference to FIG. 9, parsing the voiced region into one or more cords can comprise locating a first glottal pulse, and selecting a cord including the first glottal pulse. Locating the first glottal pulse can comprise locating a point of highest amplitude within the voiced region of the signal. The cord including the first glottal pulse can include a part of the signal beginning with the glottal pulse but exclude a part of the signal prior to a start of a subsequent glottal pulse, i.e., a transient part of the signal as discussed above. Parsing can also include locating other glottal pulses within the same region. It should be noted that, since the first glottal pulse is located based on having the highest amplitude in a give region of the signal, this pulse may not necessarily be first in time. Thus, locating other glottal pulses within a given region of the signal can comprise looking forward and backward in the region of the signal. Additional details of the processes performed by the cord finder module 240 will be discussed below with reference to FIGS. 9 and 10.

According to one embodiment, the tuning module 235 can be coupled with the cord finder module 240 and can be adapted to further tune or adjust the boundaries of the voiced regions. More specifically, the tuning module 235 can use the results of the cord finder module 240 to set the boundaries of a voiced region of the signal to begin with the onset of the first cord of the region and end with the termination of the last cord of the region. Again, it should be understood that wile illustrated here as separate from the cord finder module 240, the functions of the tuning module 235 can be alternatively performed by the cord finder module 240. Furthermore, it should be understood that the functions of the tuning module 235, regardless of how or where performed are considered to be optional and may be excluded from some implementations.

Once the cord finder 240 locates the glottal pulses in a given voiced region of the signal and selects cords around the pulses, the cords can be analyzed or processed in different ways. For example, embodiments of the present invention may be implemented in software executing on a computer for receiving and processing spoken words to perform speech-to-text functions, provide a voice command interface, perform Interactive Voice Response (IVR) functions and/or other automated call center functions, to provide speech-to-speech processing such as amplifying, clarifying, and/or translating spoken language, or to perform other functions such as noise reduction, filtering, etc. Various devices or environments in which various embodiments of the present invention may be implemented include but are not limited to telephones, portable electronic devices, media players, household appliances, automobiles, control systems, biometric access or control systems hearing aids, cochlear implants, etc. Other devices or environments in which various embodiments of the present invention may be implemented are contemplated and considered to be within the scope of the present invention.

Figure 3:
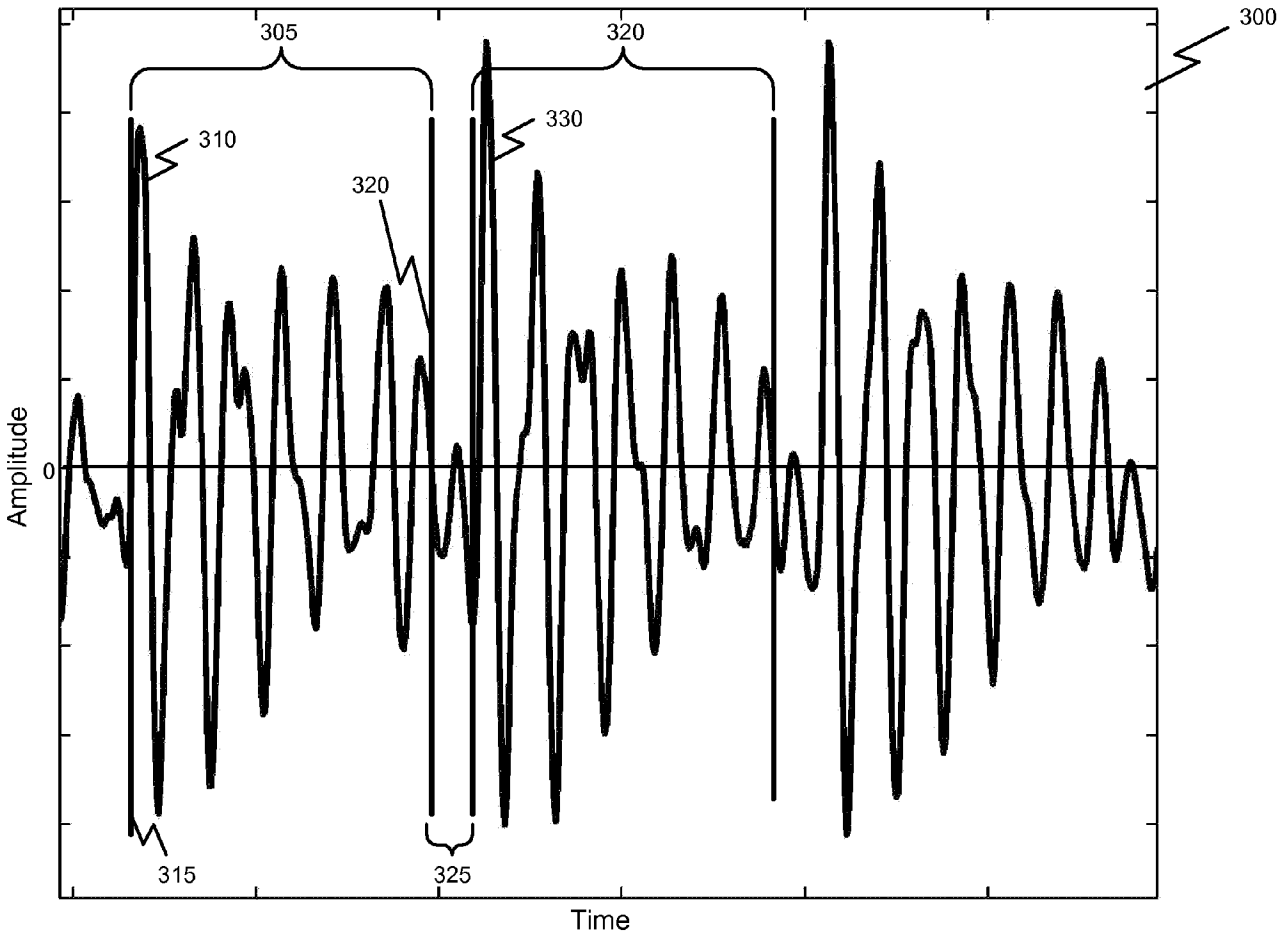
FIG. 3 is a graph illustrating an exemplary electrical signal representing speech including delineation of portions used for speech processing according to one embodiment of the present invention.

FIG. 3 is a graph illustrating an exemplary electrical signal representing speech including delineation of portions used for speech recognition according to one embodiment of the present invention. As in the example illustrated in FIG. 1, this example illustrates a signal 300 that includes a series of glottal pulses 310 and 330 followed by a series of lesser peaks and a period of transients or echoes just prior to the start of another glottal pulse.

As noted, the signal 300 can be parsed, for example by a cord finder module as described above, into one or more cords 305 and 320 based on occurrence of one or more glottal pulses 310 and 330. As can be seen, the one or more cords 305 and 320 can collectively represent less than all of the signal 300 since each of the one or more cords 305 and 320 can include a part of the signal 300 beginning with the glottal pulse 310, i.e., at the zero crossing 315 at the beginning of the pulse, but exclude a part of the signal prior to a start of a subsequent glottal pulse 330, i.e., the transients 325. According to one embodiment, the transients 325 can be considered to be that portion of the signal prior to the start of a subsequent glottal pulse 330. For example, the transients can be measured in terms of some predetermined number of zero crossings, e.g., the second zero crossing 320 prior to the start of a glottal pulse 310 and 330.

Figure 4:
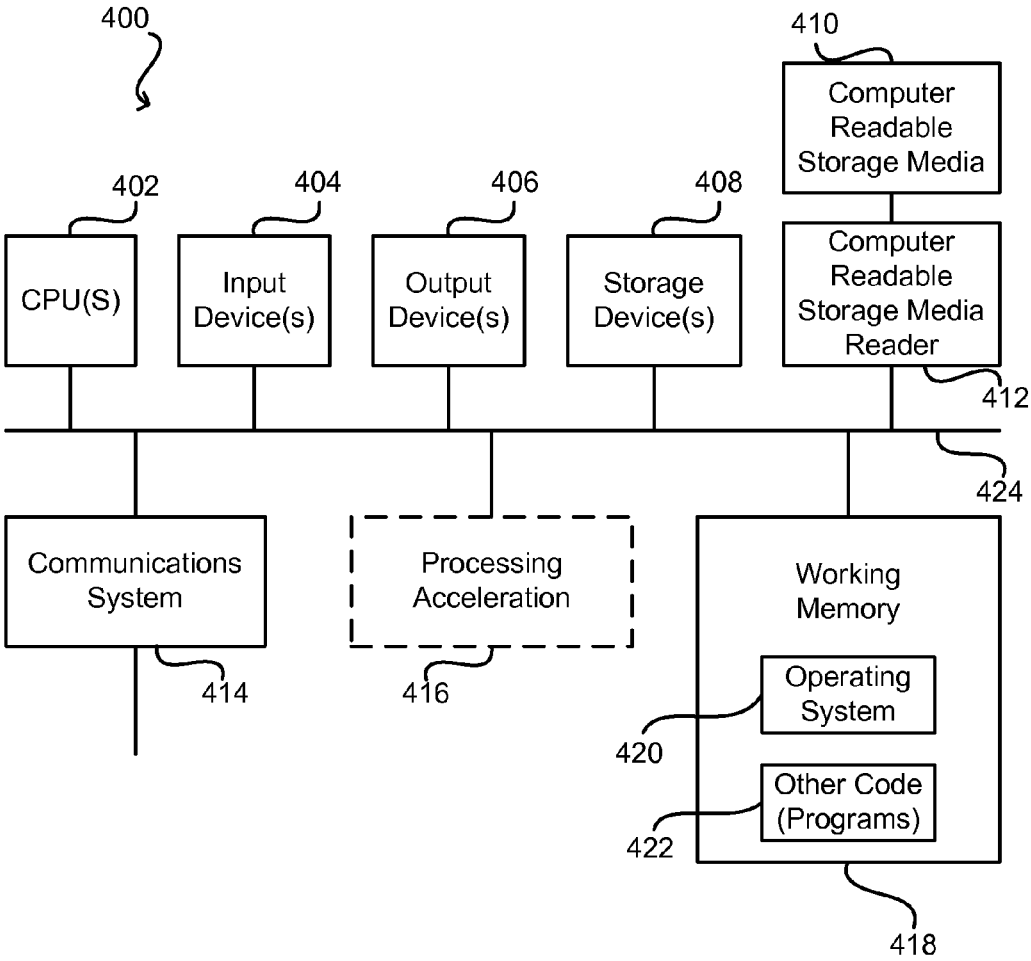
FIG. 4 is a block diagram illustrating an exemplary computer system upon which embodiments of the present invention may be implemented.

It should be noted that embodiments of the present invention may be implemented by software executed by a general purpose or dedicated computer system. FIG. 4 is a block diagram illustrating an exemplary computer system upon which embodiments of the present invention may be implemented. In this example, the computer system 400 is shown comprising hardware elements that may be electrically coupled via a bus 424. The hardware elements may include one or more central processing units (CPUs) 402, one or more input devices 404 (e.g., a mouse, a keyboard, microphone, etc.), and one or more output devices 406 (e.g., a display device, a printer, etc.). The computer system 400 may also include one or more storage devices 408. By way of example, the storage device(s) 408 can include devices such as disk drives, optical storage devices, solid-state storage device such as a random access memory ("RAM") and/or a read-only memory ("ROM"), which can be programmable, flash-updateable and/or the like.

The computer system 400 may additionally include a computer-readable storage media reader 412, a communications system 414 (e.g., a modem, a network card (wireless or wired), an infra-red communication device, etc.), and working memory 418, which may include RAM and ROM devices as described above. In some embodiments, the computer system 400 may also include a processing acceleration unit 416, which can include a digital signal processor DSP, a special-purpose processor, and/or the like.

The computer-readable storage media reader 412 can further be connected to a computer-readable storage medium 410, together (and, optionally, in combination with storage device(s) 408) comprehensively representing remote, local, fixed, and/or removable storage devices plus storage media for temporarily and/or more permanently containing computer-readable information. The communications system 414 may permit data to be exchanged with the network and/or any other computer described above with respect to the system 400.

The computer system 400 may also comprise software elements, shown as being currently located within a working memory 418, including an operating system 420 and/or other code 422, such as an application program (which may be a client application, Web browser, mid-tier application, RDBMS, etc.). It should be appreciated that alternate embodiments of a computer system 400 may have numerous variations from that described above. For example, customized hardware might also be used and/or particular elements might be implemented in hardware, software (including portable software, such as applets), or both. Further, connection to other computing devices such as network input/output devices may be employed.

Storage media and computer readable media for containing code, or portions of code, can include any appropriate media known or used in the art, including storage media and communication media, such as but not limited to volatile and non-volatile, removable and non-removable media implemented in any method or technology for storage and/or transmission of information such as computer readable instructions, data structures, program modules, or other data, including RAM, ROM, EEPROM, flash memory or other memory technology, CD-ROM, digital versatile disk (DVD) or other optical storage, magnetic cassettes, magnetic tape, magnetic disk storage or other magnetic storage devices, data signals, data transmissions, or any other medium which can be used to store or transmit the desired information and which can be accessed by the computer. Based on the disclosure and teachings provided herein, a person of ordinary skill in the art will appreciate other ways and/or methods to implement the various embodiments.

Software stored on and/or executed by system 400 or another general purpose or special purpose computer can include instructions for performing speech processing as described herein. As noted above, according to one embodiment, speech processing can comprise receiving and classifying a signal representing speech. Frames of the signal classified as voiced can be parsed into one or more regions based on occurrence of one or more events, e.g., one or more glottal pulses, within the voiced frame and one or more cords can identified within the region According to one embodiment, the one or more cords can collectively represent less than all of the signal. For example, each of the one or more cords can include a part of the signal beginning with the glottal pulse but exclude a part of the signal prior to a start of a subsequent glottal pulse. Additional details of such processing of a signal representing speech according to various embodiments of the present invention are described below with reference to FIGS. 5-10

Figure 5:
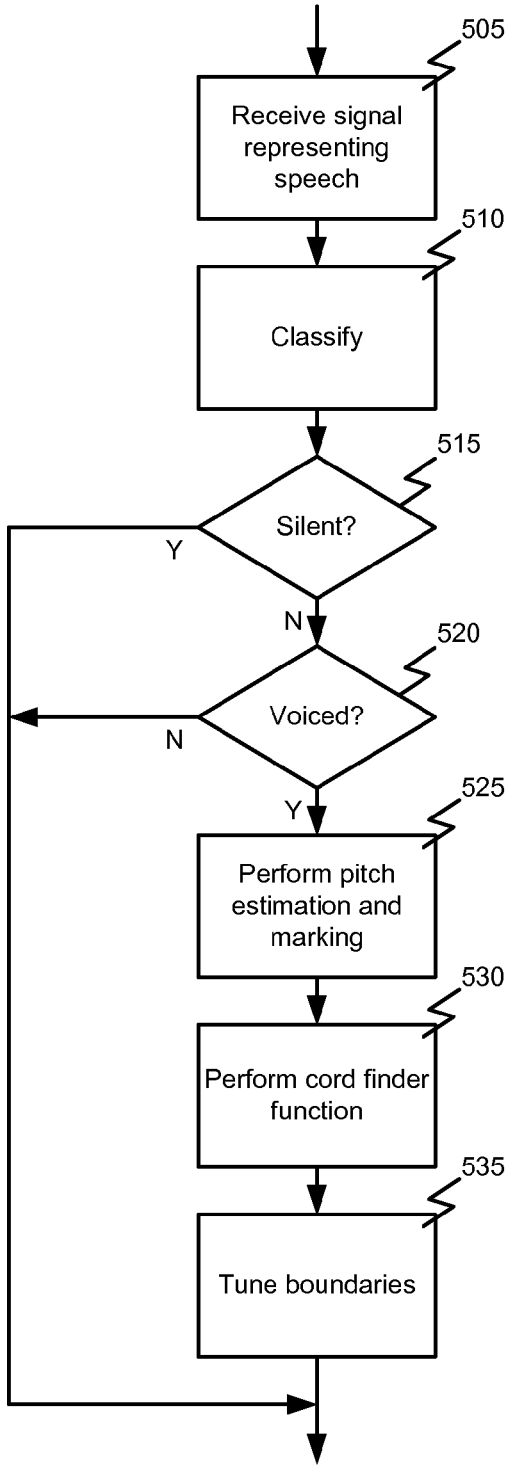
FIG. 5 is a flowchart illustrating speech processing according to one embodiment of the present invention.

FIG. 5 is a flowchart illustrating a process for performing speech processing according to one embodiment of the present invention. More specifically, this example represents an overview of the processes of classifying, pitch estimation and marking, and cord finding as outlined above with reference to the system illustrated in FIG. 2. In this example, the process begins with receiving 505 a frame of a signal representing speech. As noted above, the signal may be a live or recorded stream representing the spoken sounds. The frame can be received 505 from a uniform framing process as known in the art.

The frame can be classified 510. As noted above, the frame can be classified 510 into "voiced," "unvoiced," or "silent" frames. As used herein "voiced" refers to speech in which the glottis of the speaker moves. So, for example, a voiced sound would include vowels. "Unvoiced" refers to speech in which the glottis of the speaker does not move. So, for example, an unvoiced sound can include consonant sounds. A "silent" or quiet frame of the signal refers to a frame that does not include detectable speech. Additional details of an exemplary process for classifying 510 a frame of the signal will be described below with reference to FIG. 6.

A determination 515 can be made as to whether a frame of the signal is silent. If 515 the frame is not silent, a determination 520 can be made as to whether the frame is voiced. As will be discussed below with reference to FIG. 6, classifying the frame of the signal as voiced or unvoiced can be based on the distance between consecutive zero crossings within a frame of the signal. So, for example, in response to this zero crossing distance in a frame of the signal exceeding a threshold amount, the frame can be classified as voiced.

If 520 the frame is voiced, pitch estimation and marking can be performed. Generally speaking, the pitch estimation and marking can comprise parsing or marking the voiced frame into one or more regions based on an estimated pitch for that region and the occurrence of events, i.e., glottal pulses within the signal. Details of exemplary processes for pitch estimation and marking are described below with reference to FIGS. 7 and 8. As noted above, the pitch marking process can be tuned or adjusted. More specifically, such tuning can check the gaps between the marked events within the region. If a gap between any two events exceeds an expected gap, a check can be made for an event occurring between the marked events. For example, the expected gap can be based on the expected distance between events for a given pitch estimate. If the gap equals a multiple of that expected gap, the gap can be considered to be excessive and a check can be made for an event falling within the gap. Also as noted above, such tuning is considered to be optional and may be excluded from some implementations.

After pitch estimation and marking 525, a cord finder function 530 can be performed. Generally speaking, the cord finder function 530 can comprise parsing the voiced and marked regions into one or more cords based on occurrence of one or more events within the region. As noted, the one or more events can comprise one or more glottal pulses. Each of the one or more cords can begin with occurrence of a glottal pulse and the one or more cords can collectively represent less than all of the signal. Additional details of the cord finder function 530 will be discussed below with reference to FIG. 9 describing a process for identifying a cord onset and FIG. 10 describing a process for identifying a cord termination.

According to one embodiment and as noted above, the results of the cord finder function 530 can be used to set or tune 535 the boundaries of a voiced region of the signal to begin with the onset of the first cord of the region and end with the termination of the last cord of the region. Again, it should be understood that such tuning 535 is considered to be optional and may be excluded from some implementations.

Figure 6:
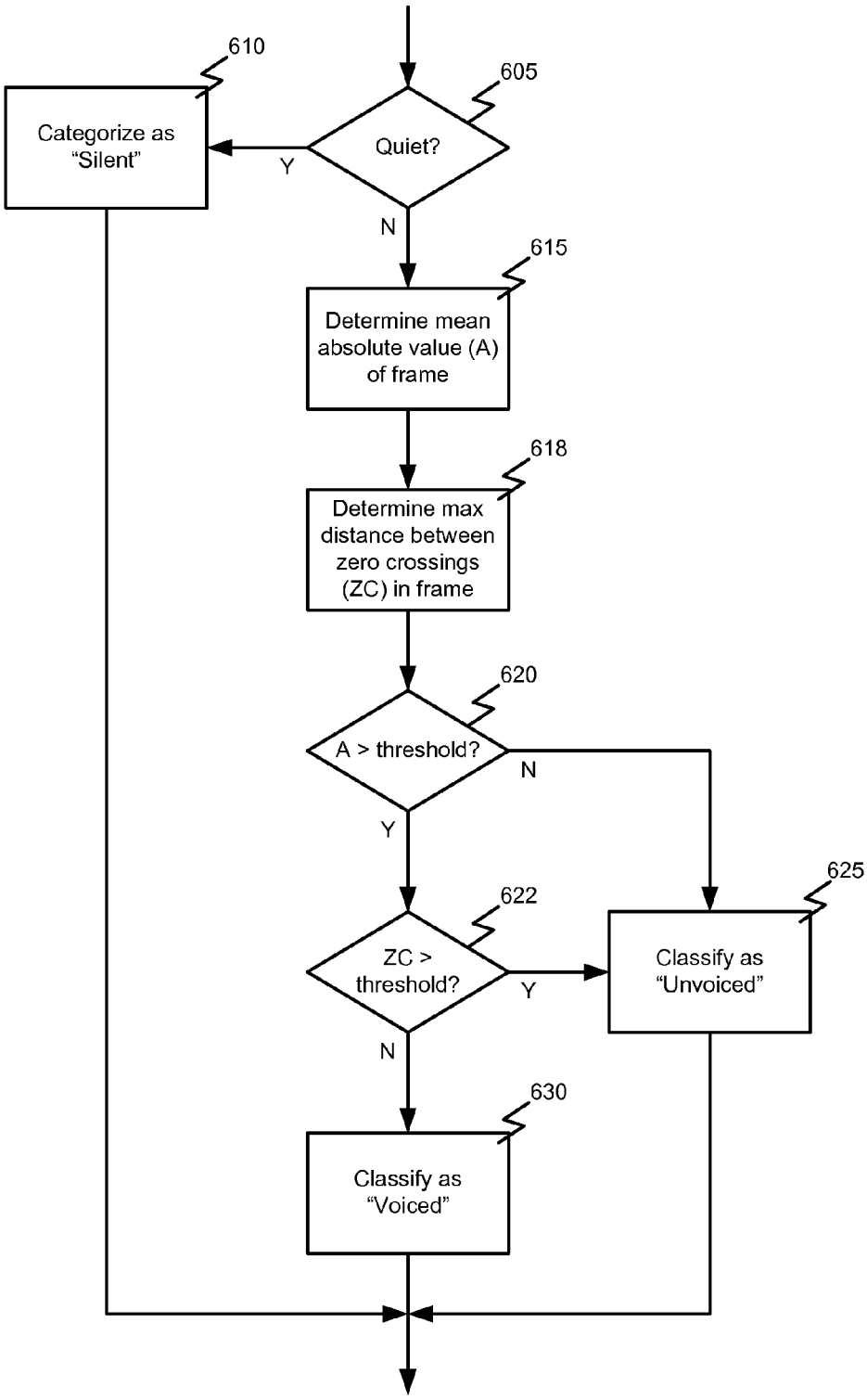
FIG. 6 is a flowchart illustrating a process for classifying a portion of an electrical signal representing speech according to one embodiment of the present invention.

FIG. 6 is a flowchart illustrating a process for classifying a frame of an electrical signal representing speech according to one embodiment of the present invention. In this example, the process begins with determining 605 whether the frame is silent. That is, a determination 605 can be as to whether the option includes detectable speech. This determination 605 can, for example, be based on the level and/or amplitude of the signal in that frame. If 605 the frame does not include detectable speech, i.e., the frame is quiet, the frame can be classified 610 as silent.

If 605 the frame does include detectable speech, i.e., the frame is not quiet, a mean absolute value of the amplitude (A) for the frame can be determined 615. A zero crossing distance (ZC), i.e., the maximum distance (time) between the zero crossings within the frame can be determined 618. A determination 620 can then be made as to whether the frame is voiced or unvoiced based on mean absolute value of the amplitude (A) for the frame and zero crossing distance (ZC) for that frame. For example, a determination 620 can be made as to whether the mean absolute value of the amplitude (A) for the frame exceeds a threshold amount. In response to determining 620 that the mean absolute value of the amplitude (A) for the frame does not exceed the threshold amount, the frame can be classified as unvoiced 625.

In response to determining 620 that the mean absolute value of the amplitude (A) for the frame does exceed the threshold amount, a further determination 622 can be made as to whether the zero crossing distance (ZC) for that frame exceeds a threshold amount. This determination 622 can be made based on a predefined threshold limit ($ZC_0$), e.g., $ZC<ZC_0$. An exemplary value for this threshold amount can be approximately 600 μsec. However, in various implementations, this value may vary, for example ±25%. Alternatively, the determination 622 of whether the zero crossing distance (ZC) for the frame exceeds the threshold amount can be based on other comparisons. For example, the determination 622 can be based on the comparison $ZC<m*A+ZC_1$ where: m is a slope defined in μsec/amplitude units, A is the mean absolute value of the amplitude, and $ZC_1$ is and alternate zero-crossing threshold. An exemplary value for the slope defined in μsec/amplitude units (m) can be approximately −3 μsec/amplitude units. However, in various implementations, this value may vary, for example ±25%. An exemplary value for the alternate zero-crossing threshold can be approximately 1250 μsec. However, in various implementations, this value may vary, for example ±25%. Regardless of the exact comparison made or values used, in response to determining 622 the zero crossing distance (ZC) for the frame does not exceed the threshold amount, that frame of the signal can be classified 625 as unvoiced. In response to determining 622 the zero crossing distance (ZC) for the frame does exceed the threshold amount, that frame of the signal can be classified 630 as voiced.

Figure 7:
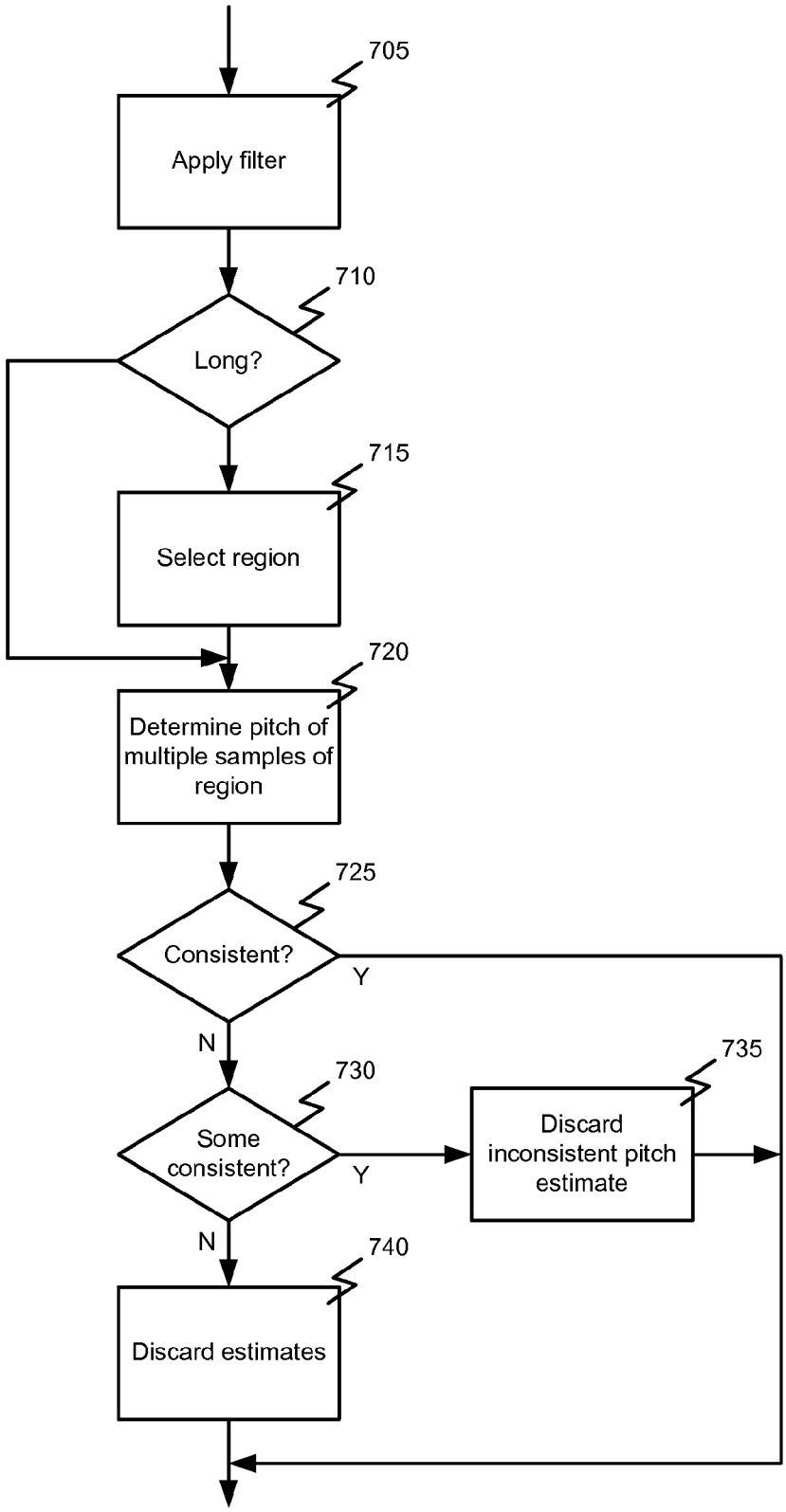
FIG. 7 is a flowchart illustrating a process for pitch estimation of a portion of an electrical signal representing speech according to one embodiment of the present invention.

FIG. 7 is a flowchart illustrating a process for pitch estimation of a frame of a signal representing speech according to one embodiment of the present invention. In this example, the pitch estimation process begins with applying 705 a filter to a frame of the signal representing the spoken sounds. According to one embodiment, applying 705 the filter to the signal can comprise applying 705 a low-pass filter, for example with a range of approximately 2 kHz, to a frame.

A determination 710 can be made as to whether the frame is long. For example, a frame may be considered long if it exceeds 15 msec or other value. In response to determining 710 that the frame is long, a sub-frame of a predetermined size can be selected 715 from the frame. For example, a sub-frame of 15 msec can be selected 715 from the middle of the frame.

A set of pitch values can be determined 720 based on multiple portions of the frame. For example, the set of pitch values can comprise a first pitch value for a first half of the frame, a second pitch value for a middle half of the frame, and a third pitch value for a last half of the frame. Alternatively, a different number and arrangement of the set of pitch values is contemplated and considered to be within the scope of the present invention. For example, in another implementation, two pitch values spanning the first half and second half of the frame may be determined.

Determining 720 the set of pitch values can be performed using any of a variety of methods understood by those skilled in the art. For example, determining 720 the pitch can include, but is not limited to, performing one or more Fourier Transforms, a Cepstral analysis, autocorrelation calculation, Hilbert transform, or other process. According to an exemplary process, pitch can be determined by determining the absolute value of the Hilbert transform of the segment (H). An n-point average of H can be determined ($H_s$), where approximately 10 ms of data is averaged for each point in $H_s$. Additionally, a scaled version of H ($H_f$) can be determined and defined as $H_f=C*H_s$, where C is a scaling constant (~1.05). A new signal (P) can be created where P is defined as:

$$P=S-H_f, \text{ for } S>H_f$$

$$P=S+H_f, \text{ for } S<-H_f$$

$$P=0 \text{ otherwise}$$

The local maxima of either the cepstrum of P or the autocorrelation of P can be used to identify potential pitch candidates. The natural limits of pitch for human speech can be used to eliminate candidates outside of reasonable values (approximately 60 Hz to approximately 400 Hz). The candidates can be sorted by peak amplitude. If the two strongest peaks are within a given span of each other, e.g., 0.3 ms of each other, the strongest peak can be used as the estimate of the pitch. If one of the peaks is near (+/−15%) an integral multiple of the other peak, the smaller of the two peaks can be used as the estimate of the pitch.

According to one embodiment, a consistency of each of the set of pitch values can be determined 725 and 730. For example, if 725 the values of the set of pitch values are determined to be consistent, say within 5-15%, the pitch values can be considered to be reliable and usable. However, if 725 the values of the set of pitch values are determined to not be consistent, say within 5-15%, but some consistency is found 730, one or more, depending on the number of value calculated, that are inconsistent can be discarded 735. If 725 and 730 the values of all the set of pitch values are determined to be inconsistent, for example none of the values are within 5-15% of each other, the set of values can be discarded 740.

Figure 8:
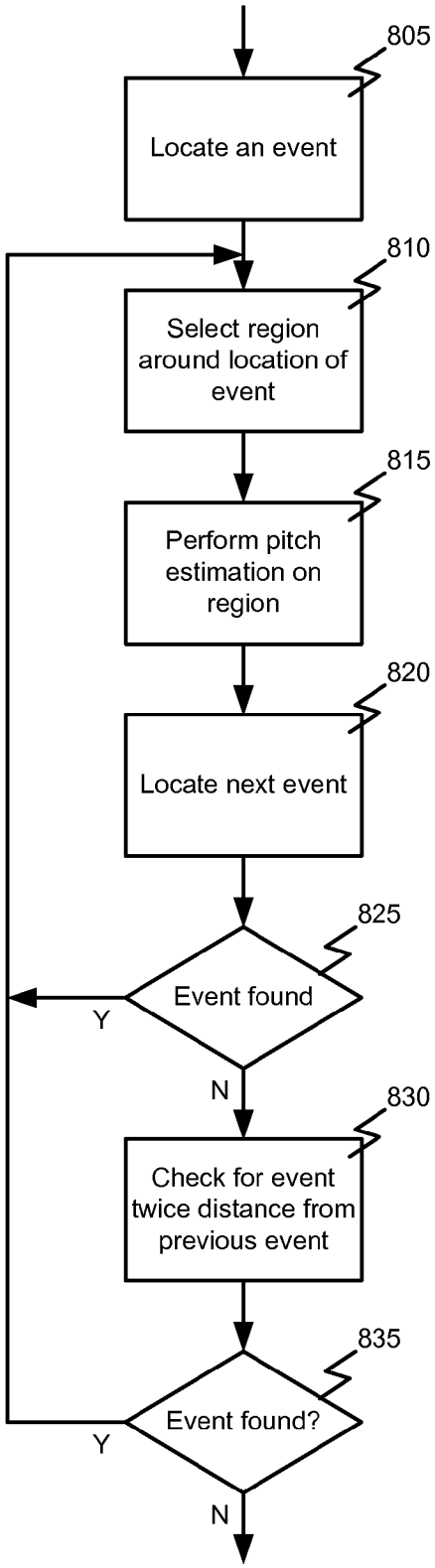
FIG. 8 is a flowchart illustrating a process for pitch marking of a portion of an electrical signal representing speech according to one embodiment of the present invention.

FIG. 8 is a flowchart illustrating a process for pitch marking of a frame of an electrical signal representing speech according to one embodiment of the present invention. In this example, pitch marking can comprise parsing the voiced frame into one or more regions begins with locating 805 a first event, i.e., a first glottal pulse. Locating 805 the first glottal pulse can comprise checking for presence of a high-amplitude spike in the frame.

A region can be selected 810 including the first event or glottal pulse. The region can include a part of the signal beginning with the first glottal pulse but excluding a part of the signal prior to a start of a subsequent glottal pulse. That is, the region can include, for example, a part of the signal beginning with the glottal pulse, i.e., at the zero crossing at the beginning of the pulse, but can exclude a part of the signal prior to a start of a subsequent glottal pulse, i.e., the transients discussed above. Thus, the region can begin with a glottal pulse and include the cord but exclude transients at the end of the cord. An exemplary process for identifying the end of the cord, i.e., the end of the region, is described below with reference to FIG. 10.

Pitch estimation 815 can be performed on the selected region. That is, a pitch of the speakers voice can be determined from the region. Details of an exemplary process for performing pitch estimation 815 are described above with reference to FIG. 7.

A second or other event or glottal pulse can be located 820. Locating 820 the second glottal pulse can comprise checking for presence of a high-amplitude spike in the frame a predetermined distance from the first glottal pulse. For example, checking for the presence of another glottal pulse or locating another glottal pulse can comprise checking forward or backward in the frame a fixed amount of time. It should be noted that since the first glottal pulse is located based on having the highest amplitude in a given frame of the signal, this pulse may not necessarily be first in time. Thus, locating other glottal pulses within a given frame of the signal can comprise looking forward and backward in the frame of the signal. The fixed amount of time may, for example, fall in the range of 5-10 msec or another range. According to one embodiment, the distance from the previous glottal pulse may vary depending upon the previous pitch or pitches determined by one or more previous iterations of the pitch estimation process 815. Regardless of how this distance is determined, a window can be opened, i.e., a span of the signal can be checked, in which a check can be made for another high-amplitude spike, i.e., another glottal pulse. According to one embodiment, this window or span may comprise from 5-10 msec in length. In another embodiment, the span may also vary depending upon the previous pitch or pitches determined by one or more iterations of the pitch marking process 815.

A determination 825 can be made as to whether an event or glottal pulse is found within the window or span of the signal. In response to finding another glottal pulse, another region of the signal can be selected 810. In response to determining 825 that no glottal pulse is located within the predetermined distance from the first glottal pulse or within the frame being checked, a check 830 can be made for presence of a high-amplitude spike in the frame at twice the predetermined distance from the first glottal pulse. That is, if a glottal pulse is not found 825 at the predetermined distance from the previous glottal pulse, the distance can be doubled, and another check 830 for the presence of a glottal pulse can be made. If 835 an event is found at twice the predetermined distance from the previous glottal pulse, another region of the signal can be selected 810. If 835 no pulse is found, the end of the frame of the signal may be assumed.

Figure 9:
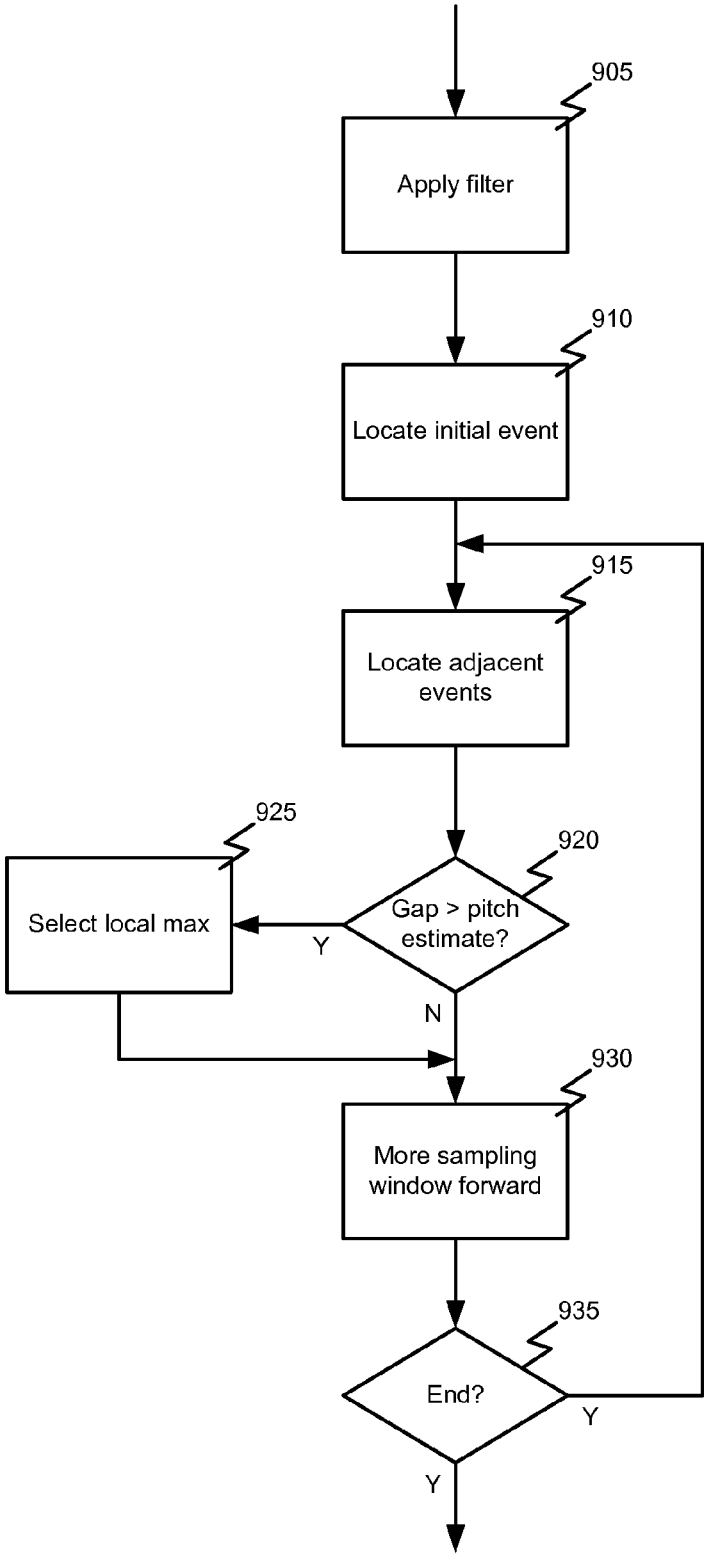
FIG. 9 is a flowchart illustrating a process for locating a cord onset event according to one embodiment of the present invention.

FIG. 9 is a flowchart illustrating a process for locating a glottal event according to one embodiment of the present invention. In this example, the process begins with applying 905 a filter to the frame of the signal representing the spoken sounds. According to one embodiment, applying 905 the filter to the frame can comprise applying 905 a low-pass filter, for example with a range of approximately 2 kHz, to obtain a filtered signal (S).

From the filtered frame of the signal (S), an initial glottal event can be located 910. Locating 910 the initial event can be accomplished in a variety of ways. For example, an initial event can be located 910 by identifying the highest amplitude peak in the signal. Alternatively, an initial event can be located 910 by selecting an initial region of the signal, for example, the first 100 ms of the signal. A set of pitch estimates can be determined for this region. An exemplary process for determining a pitch estimate is described above with reference to FIG. 7. According to one embodiment, the set of pitch estimates can comprise three estimates. The set of estimates for the initial region can then be compared to an estimate of the pitch for the entire signal ($f_0$). If any of the set of pitch estimates for the region are less than a predetermined level of the estimate for the entire signal ($f_0$), e.g., region estimate <60% of ($f_0$), then that estimate can be set to $f_0$. Locating 910 the initial event can then comprise linearly interpolating between the individual pitch estimates of the set of pitch estimates for the region and extrapolating the pitch estimates to the ends of the region by clamping to the start and end pitch estimates of the set. Glottal pulse candidates within the region can then be identified by identifying all local maxima in the region. This set of candidates can be reduced using rules such as: (a) if a peak is less than a certain level of one of its neighbors (e.g., 20%), remove it from the candidate list, and/or (b) if consecutive peaks are less than a certain time apart (e.g., 1 ms), and the second peak is less than a certain level of the amplitude of the first peak (e.g., 1.2 times), then remove the second peak from the candidate list. Once the set of candidates has been reduced, the maximum of the region can be assumed to be a glottal pulse (call it $B_0$). A pitch estimate (call it $E_{B0}$) can be determined at $B_0$ using the result of the previous step.

Once an initial glottal pulse is located 910, adjacent glottal pulses can be located 915. According to one embodiment, locating 915 adjacent glottal pulse can comprise looking forward and backward in the signal. For example, looking backwards from $B_0$ can comprise considering the set of local maxima of the region in the range $[B_0-1.2*E_{B0}\ B_0-0.8*E_{B0}]$ (a 20% neighborhood of $B_0$-$E_{B0}$). If there are glottal pulse candidates in this neighborhood, the largest, i.e., highest amplitude, candidate can be considered the next glottal pulse event, $B_1$. This can be repeated using the new cord length $(B_{n-1}-B_n)$ as the new pitch estimate for this location until no glottal pulses are detected or the beginning of the region is reached.

Similarly, locating 915 adjacent glottal pulse can comprise looking forward and backward in the signal. For example, looking backwards from $B_0$ can comprise using the difference of the last two (chronological) glottal pulses as an estimate for the location of the next glottal pulse. A check can be made for glottal pulse candidates in the 20% neighborhood of that location. According to one embodiment, if there are no candidates found, instead of using the previous glottal pulse difference as the pitch estimate, the estimate from the interpolated function can be used. Additionally or alternatively, if there are still no candidates, this section of the voiced data can be skipped and the process of locating glottal pulses restarted using a region of the signal after the skipped section.

When the end of the current region is reached, the spaces between the glottal pulses can be considered. That is, a determination 920 can be made as to whether the gap between the pulses exceeds that expected based on the pitch estimate. For example, a determination 920 can be made as to whether the gap between any consecutive pair of glottal pulses is greater than a factor of $f_0$, e.g., $3*f_0$. If 920 the gap exceeds that expected based on the pitch estimate, a well-spaced local maxima in the gap can be identified 925 and marked as a glottal pulse. The sampling window, i.e., the frame of the signal being sampled, can be moved 930 forward. According to one embodiment, the sampling window can be moved forward an amount less than the width of the sampling window. So, for example, if the region is 100 msec in width, the sampling window can be moved forward less than 100 msec (e.g., approximately 80 msec). According to one embodiment, the spacing of the glottal pulses from the overlapping part of the regions can be used to estimate the location of the next glottal pulse. A determination 935 can be made as to whether the end of the voiced section has been reached. In response to determining 935 that the end of the voiced section has not been reached, processing can continue with locating 915 adjacent pulses in the current region until the end of the voiced section.

Figure 10:
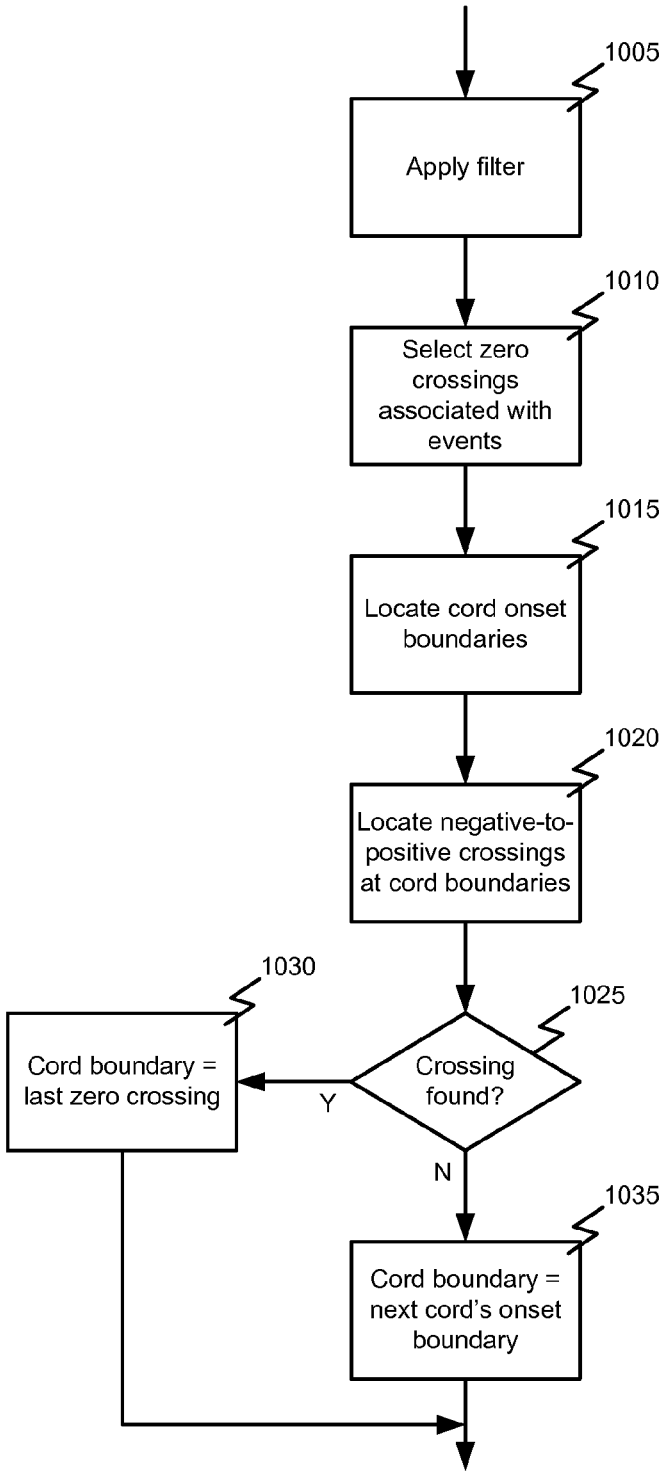
FIG. 10 is a flowchart illustrating a process for identifying a cord termination according to one embodiment of the present invention.

FIG. 10 is a flowchart illustrating a process for identifying a cord termination according to one embodiment of the present invention. In this example, processing begins with applying 1005 a filter to the signal representing the spoken sounds. According to one embodiment, applying 1005 the filter to the signal can comprise applying 1005 a low-pass filter, for example with a range of approximately 2 kHz, to a voiced section. A zero crossing prior to each glottal pulse in the filtered section can be identified 1010. Cord onset boundaries can be identified 1015, for example by find the closest negative-to-positive zero crossing to the zero crossing just identified. The negative-to-positive zero crossings between consecutive pairs of cord onset boundaries can be identified 1020. If 1025 any zero crossings are found, the cord termination boundary for each pair can be set 1030 to the last zero crossing in the set. If 1025 no zero crossings are found, the cord termination boundary can be set 1035 to the next cord's onset boundary. According to one embodiment, for the final cord termination boundary, the distance between the prior two cord onset boundaries can be used as an estimate of how far past the final cord onset boundary to look for negative-to-positive zero crossings.

In the foregoing description, for the purposes of illustration, methods were described in a particular order. It should be appreciated that in alternate embodiments, the methods may be performed in a different order than that described. Additionally, the methods may contain additional or fewer steps than described above. It should also be appreciated that the methods described above may be performed by hardware components or may be embodied in sequences of machine-executable instructions, which may be used to cause a machine, such as a general-purpose or special-purpose processor or logic circuits programmed with the instructions, to perform the methods. These machine-executable instructions may be stored on one or more machine readable mediums, such as CD-ROMs or other type of optical disks, floppy diskettes, ROMs, RAMs, EPROMs, EEPROMs, magnetic or optical cards, flash memory, or other types of machine-readable mediums suitable for storing electronic instructions. Alternatively, the methods may be performed by a combination of hardware and software.

While illustrative and presently preferred embodiments of the invention have been described in detail herein, it is to be understood that the inventive concepts may be otherwise variously embodied and employed, and that the appended claims are intended to be construed to include such variations, except as limited by the prior art.

What is claimed is:

1. A method of processing a signal representing speech, the method comprising:

receiving a region of the signal representing speech, wherein the region comprises a portion of a frame of the signal representing speech classified as a voiced frame and wherein the region is marked based on one or more pitch estimates for the region; and identifying a cord within the region of the signal based on occurrence of one or more events within the region of the signal, wherein the one or more events comprise one or more glottal pulses and the cord begins with onset of a first glottal pulse and extends to a point prior to an onset of a second glottal pulse but excludes a portion of the region of the signal prior to the onset of the second glottal pulse.

2. The method of claim 1, wherein identifying the cord within the region of the signal comprises locating the first glottal pulse within the region of the signal.

3. The method of claim 2, wherein locating the first glottal pulse comprises locating a point of highest amplitude within the region of the signal.

4. The method of claim 2, further comprising locating the second glottal pulse within the region of the signal.

5. The method of claim 4, wherein locating the second glottal pulse comprises checking for presence of a high-amplitude spike in the region of the signal a predetermined distance from the first glottal pulse.

6. The method of claim 5, further comprising, in response to determining that no glottal pulse is located within the predetermined distance from the first glottal pulse, checking for presence of a high-amplitude spike in the region of the signal at twice the predetermined distance from the first glottal pulse.

7. The method of claim 4, further comprising, in response to locating the second glottal pulse, determining whether the second glottal pulse is located within a predetermined maximum distance of the first glottal pulse.

8. The method of claim 7, further comprising, in response to determining the second glottal pulse is not located within the predetermined maximum distance of the first glottal pulse, disregarding the second glottal pulse.

9. The method of claim 2, further comprising identifying a termination of the cord based on the first glottal pulse and the second glottal pulse.

10. The method of claim 9, wherein identifying the termination of the cord based on the first glottal pulse and the second glottal pulse comprises:

identifying a beginning of the first glottal pulse based on a first negative-to-positive zero crossing in the voiced frame, wherein the first negative-to-positive zero crossing is prior to the first glottal pulse;

identifying a beginning of the second glottal pulse based on a second negative-to-positive zero crossing in the voiced frame, wherein the second negative-to-positive zero crossing is prior to the second glottal pulse;

identifying a third negative-to-positive zero crossing prior to second negative-to-positive zero crossing; and setting the termination of the cord to the third negative-to-positive zero crossing.

11. A system comprising:

an input device adapted to detect sound representing speech and convert the sound to an electrical signal representing the speech; and a classification module communicatively coupled with the input device and adapted to receive a frame of the signal representing speech and classify the frame as a voiced frame a pitch estimation and marking module communicatively coupled with the classification module and adapted to mark a region of the voiced frame based on one or more pitch estimates for the region; and a cord finder module communicatively coupled with the pitch estimation and marking module and adapted to identify a cord within the region of the signal based on occurrence of one or more events within the region of the signal, wherein the one or more events comprise one or more glottal pulses and the cord begins with onset of a first glottal pulse and extends to a point prior to an onset of a second glottal pulse but excludes a portion of the region of the signal prior to the onset of the second glottal pulse.

12. The system of claim 11, wherein identifying the cord within the region of the signal comprises locating the first glottal pulse within the region of the signal.

13. The system of claim 12, wherein locating the first glottal pulse comprises locating a point of highest amplitude within the region of the signal.

14. The system of claim 12, wherein the cord finder module is further adapted to locate the second glottal pulse within the region of the signal.

15. The system of claim 14, wherein locating the second glottal pulse comprises checking for presence of a high-amplitude spike in the region of the signal a predetermined distance from the first glottal pulse.

16. The system of claim 15, wherein the cord finder module is further adapted to check for presence of a high-amplitude spike in the region of the signal at twice the predetermined distance from the first glottal pulse in response to determining that no glottal pulse is located within the predetermined distance from the first glottal pulse.

17. The system of claim 14, wherein the cord finder module is further adapted to determine whether the second glottal pulse is located within a predetermined maximum distance of the first glottal pulse in response to locating the second glottal pulse.

18. The system of claim 17, wherein the cord finder module is further adapted to disregard the second glottal pulse in response to determining the second glottal pulse is not located within the predetermined maximum distance of the first glottal pulse.

19. The system of claim 12, wherein the cord finder module is further adapted to identify a termination of the cord based on the first glottal pulse and the second glottal pulse.

20. The system of claim 19, wherein identifying the termination of the cord based on the first glottal pulse and the second glottal pulse comprises:

identifying a beginning of the first glottal pulse based on a first negative-to-positive zero crossing in the voiced frame, wherein the first negative-to-positive zero crossing is prior to the first glottal pulse;

identifying a beginning of the second glottal pulse based on a second negative-to-positive zero crossing in the voiced frame, wherein the second negative-to-positive zero crossing is prior to the second glottal pulse;

identifying a third negative-to-positive zero crossing prior to second negative-to-positive zero crossing; and setting the termination of the cord to the third negative-to-positive zero crossing.

* * * * *